US006694907B1

(12) United States Patent
Muldoon

(10) Patent No.: US 6,694,907 B1
(45) Date of Patent: Feb. 24, 2004

(54) SAILBOAT HULL AND METHOD FOR REDUCING DRAG CAUSED BY LEEWAY

(76) Inventor: Patrick Craig Muldoon, 1071 Sinking Creek Rd., Hoges Chapel, VA (US) 24136

( * ) Notice: Subject to any disclaimer, the term of this patent is extended or adjusted under 35 U.S.C. 154(b) by 0 days.

(21) Appl. No.: 10/387,470

(22) Filed: Mar. 14, 2003

(51) Int. Cl.[7] ..... B63B 35/79
(52) U.S. Cl. ..... 114/39.25; 114/140
(58) Field of Search ..... 114/39.11, 39.21, 114/39.25, 140

(56) References Cited

U.S. PATENT DOCUMENTS 4,644,889 A * 2/1987 Krans ..... 114/40
5,163,377 A * 11/1992 Calderon et al. ..... 114/39.25
6,223,679 B1 * 5/2001 Filipczak ..... 114/355
6,325,009 B1 * 12/2001 Schulz et al. ..... 114/56.1
2003/0106477 A1 * 6/2003 Hood et al. ..... 114/40

* cited by examiner

*Primary Examiner*—Stephen Avila
(74) *Attorney, Agent, or Firm*—Patrick Craig Muldoon

(57) ABSTRACT

A shaped hull with a fixed angle keel with respect to the hull that when heeled, orients the keel to an angle of attack substantially related to the heel angle. The angle of attack being sufficient to create on the keel a lateral force substantially equal and opposite to the lateral force derived from the wind. The submerged portion of the hull, however, remains symmetrical and oriented parallel to the course sail as is its associated drag contribution vector. Thereby reducing or substantially eliminating the lateral force generated by the hull and the associated drag contribution. The movement of the shaped hull induces a lateral force on the keel without generating a lateral force and its associated drag on the hull, thus providing a sailboat with reduced drag without resorting to the prior art methods and their associated disadvantages.

30 Claims, 19 Drawing Sheets

SAILBOAT HULL AND METHOD FOR REDUCING DRAG CAUSED BY LEEWAY

BACKGROUND

A primary concern in the development of sailing vessels has been the persistent quest and desire to improve speed. More sail area, more efficient sails, low friction paint, lighter materials and a plethora of hull designs have been created in furtherance of this venture. In the arena of hull designs, the principle approach is concentrated on reducing the hull drag thus increasing the speed for a given driving force derived from the sails.

FIGS. 1A–1B show the different forces acting on a sailing yacht 100. These figures are described in detail in Larson, L., Eliasson, R E., "Principles of Yacht Design", International Marine/Ragged Mountain Press, 2nd edition (Jun. 2, 2000), the entirety of which is herein incorporated by reference. (In the plan view the horizontal components of the forces are displayed, while the lateral and vertical forces are shown in the rear view.) When the hull is driven through the water a resistance is developed. Under equilibrium conditions, when the yacht is sailing at constant speed in a given direction, the resistance is balanced by a driving force from the sails. Unfortunately, this equilibrium condition cannot be created without at the same time obtaining a side force, which in turn is balanced by a hydrodynamic lateral force or side force. The latter is developed by the underwater body when sliding slightly sideward. This deviation from the steered course is the leeway angle $\lambda$, resulting in a leeway of V sin $\lambda$. Since the turning moment $M_k$, under equilibrium conditions must be zero, the resulting hydrodynamic and aerodynamic forces in the horizontal plane must act essentially along the same line. The drag force and lateral force are force vectors parallel to the vectors $\hat{j}_S$ and $\hat{i}_S$ respectively, of the course sailed reference frame $\overline{S}$, as are the driving and heeling forces created by the wind. The axis $\hat{j}_S$ of reference frame $\overline{S}$ is oriented parallel to the velocity vector of the sailboat and defines a plane with $\hat{i}_S$ that is parallel to the surface of the body of water in which the sailboat rests, $\overline{S}$ is not a inertial reference. In contrast the boat reference frame $\overline{B}$ includes vectors $\hat{i}$, $\hat{j}$ and $\hat{k}$ representing the longitudinal, lateral and vertical axis of the boat, reference frame $\overline{B}$ respectively, which is fixed in the sailboat.

The view at the bottom of FIG. 1 is along the direction of motion $\hat{j}_S$. It is seen that the resulting hydrodynamic and aerodynamic forces are at right angles to the mast. This is not exactly true but is an approximation made in sailing yacht theory. The heeling moment from the aerodynamic force is balanced by the righting moment from the buoyancy force and weight. The angle from perpendicular $\hat{k}_S$ of the sailboat caused by heeling is defined as the heeling angle $\phi$.

In FIG. 1A the apparent wind direction is shown. This is not the true wind direction, since the wind felt onboard the yacht is influenced by its speed through the air. FIG. 2 illustrates the relations between the true and apparent wind speeds and direction, the velocity triangle.

FIG. 3 shows a resistance curve for a typical sailboat being towed upright in smooth water. At low speeds the dominating component is the viscous resistance due to frictional forces between the hull and the water. The friction gives rise to eddies of different sizes, which containing energy left behind the hull in the wake. This component increases relatively slowly with speed, as opposed to the second component, the wave resistance, which occurs because the hull generates waves, transferring energy away from the vessel. The sum of the viscous and wave resistance components is referred to as the upright resistance.

FIG. 4 shows a breakdown of the total resistance of a typical sailboat beating to windward at 6.8 knots in a fresh breeze. The viscous resistance has been subdivided into components. In addition to the viscous and wave components, there are three new forces: heel, induced resistance and added resistance. The heel resistance is the sum of the changes in viscous and wave resistance due to heel. This component is introduced in sailing theory for convenience. Since the method for obtaining the two resistance components for upright hulls are well established in ship hydrodynamics it is an advantage to consider the effects of heel separately.

The induced resistance is cause by the leeway. When the yacht is moving slightly sideways, water flows from the higher pressure on the leeward side, below the tip of the keel and rudder, and also below the bottom of the hull, to the lower pressure on the windward side, thus creating longitudinal vortices.

There are four major resistance components: the viscous resistance, the wave resistance, the induced resistance and the added resistance in wave. All of which are functions of the shape of the hull.

FIG. 5 shows a typical pressure distribution on the hull at a given depth. It is seen that the bow and stem pressures are higher than in the undisturbed water at this depth, while the pressure in the middle part of the hull is lower. A slightly lower pressure is found at the stern than at the bow, giving rise to the resistance component, which is indirectly cased by friction through the boundary layer.

The pressure distribution is related to the Fineness Ratio (FR) which is generally analogous to a first order aspect ratio. The larger the FR, the less significant the pressure differential and the component of drag associated with the pressure differential. The FR commonly applied in aeronautics to quantify the drag on a fuselage and is defined by the length of fuselage divided by its width, L/w.

The higher the FR the lower the pressure drag induced on a body. As in an aircraft the penalty of increasing FR is an increase in the friction component of the viscous drag; however, the reduction of pressure drag generally more than offsets this increase. A detrimental consequence of leeway is a reduction in the FR, as seen in FIG. 1. The width of the hull $w_{cs}$ is increased to $w_{lw}$, and the length is decreased generally as a function of $L_{lwl}$ sin $\lambda$ and $L_{lwl}$ cos $\lambda$ respectively, where $L_{lwl}$ is the length of the hull at the water line, resulting in the FR being reduced and an increase in pressure drag.

The drag increase due to heel and leeway while related and generally described in relationship with FR described above, is more completely described by modeling the submerged hull and the keel as two distinct airfoils. In the case of the hull a very poor airfoil, in this case $\lambda$ is analogous to the angle of attack $\alpha$.

The submerged portion of the hull can be modeled as a short symmetric hydrofoil. The hull hydrofoil for a typical sailboat has a relatively sharp leading edge and a more blunt trailing edge, as seen from FIG. 1. The result of these characteristics further diminish the drag performance desired in hydrofoils and analogously airfoils by increasing the onset of flow separation for $|\lambda|\neq 0$ and reducing pressure recapture for all $\lambda$. As with all hydrofoils of symmetric nature, the lift and drag are a function of the leeway angle $\lambda$. The minimum drag coefficient $C_{Do}$ occurs at $\lambda=0$ and while lift or lateral force increases generally linearly with $\lambda$, the drag increases exponentially proportional to $\lambda^2$. An additional component of drag related to the induced drag is predominantly a function of the three dimensional characteristics of the hydrofoil, specifically the Aspect Ratio (AR) defined as $b^2/S$ where b is twice the depth of the hull and S is twice the lateral surface area of the submerged hull projected normal to the lateral axis. The resulting drag coefficient is generally given as:

$$C_D = C_{D_0} + \frac{\left(\frac{\partial C_l}{\partial \lambda}\lambda\right)^2}{AR\pi}$$

where $$\frac{\partial C_l}{\partial \lambda}$$

is the slope of the lift curve. Thus the hull for typical sailboats have a very low AR and accordantly for $\lambda \neq 0$ a very undesirable L/D ratio.

The keel, on the other hand, is not subject to the same constraints and limitation as the hull, such as buoyancy, cabin space, heel stability, bending moments and other structural and functional requirements implicit to the hull. Therefore, the keel can be designed with more favorable hydrofoil characteristics to achieve an advantageous L/D ratio. However, regardless of how well designed the keel, the leeway angle of both the hull and the keel are identical. Therefore to obtain the necessary lateral side force to counteract the lateral component of drag and lift created by the sail, a drag penalty in addition to that associated with the lift or lateral force creation function of the keel is experienced due to the encumbrance of the hull, thus reducing the speed of the sailboat.

Several prior art approaches have been employed to reduce this drag penalty. Single tack racing sailboats have been created that include a cambered keel that has a fixed angle of incidence $\alpha_i$ so that no leeway angle is experience by the hull at the design speed. However, these specialized craft do hot operate effectively on the opposite tack or other off design environments, a characteristic that renders such craft unusable in cruising and a vast majority of racing formats.

Another common approach in the prior art has been to have a variable angle keel with respect to the hull. The angle of attack of the keel is varied by the crew in order to reduce or eliminate the leeway angle experienced by the hull. While these keels are effective, the mechanical requirements add some complexity to the sailboat and take additional mental effort by the crew to coordinate the keel angle and rudder deflection with the lateral force required to balance the sailboat while maintaining a proper course and proper sail trim. Furthermore, most racing formats discourage or restrict the use of variable angle keels.

The subject matter of the present disclosure seeks to reduce the hull component of heel resistance in its various forms, including but not limited to those discussed above, which essentially is the marginal increase of the resistance components due to the leeward motion of the sailboat with respect to the course steered.

The objects of the subject matter of the disclosure and embodiments herein provide a hull with a fixed angle keel with respect to the hull that when heeled, orients the keel to an angle of attack substantially related to the heel angle. The angle of attack being sufficient to create on the keel a lateral force substantially equal and opposite to the lateral force derived from the wind. The submerged portion of the hull however, remains symmetrical and oriented parallel to the course sail as does its associated drag contribution vector. Thereby reducing or substantially eliminating the lateral force generated by the hull and the associated drag contribution.

It is an object of the disclosure to overcome the problems in the prior art and present a novel sailboat hull. An embodiment of the sailboat hull having a bow, a stem, a starboard side, a port side and a keel, the hull defined with a longitudinal axis, a lateral axis, and a vertical axis, each of said axes is perpendicular to each of the other axes. An embodiment of the sailboat hull having a first plane defined by said longitudinal axis and said vertical axis and a bottom surface symmetric with respect to said first plane. The hull is further defined by at least one starboard straight line lying on the starboard side of said first plane and intersecting the first plane at a point at or aft of the stem. The hull contains a plurality of starboard cross sections located along the starboard straight line, each with a hull contour defined by the intersection of one of a plurality of cutting planes and the bottom surface on said starboard side and an orthogonal line perpendicular to a line tangent to the hull contour, and intersecting the starboard straight line. The orthogonal line of the hull embodiment is within the respective one of the plurality of cutting planes; and a portion of the hull contour proximate to the orthogonal line is symmetric with respect to the orthogonal line. The sailboat hull having at least one of said plurality of starboard cross sections located between $\frac{2}{3}^{rds}$ of the hull length $L_{lwl}$ and the bow of the hull and, the keel is symmetric with respect to said first plane.

It is another object of the disclosed subject matter to present a sailboat hull with a bow, a stem, a starboard side, a port side and a keel. The hull defined by a longitudinal axis, a lateral axis, and a vertical,:axis, where each of said axes is perpendicular to each of the other axes. The hull contains a first plane defined by the longitudinal and vertical axis; a bottom surface symmetric with respect to the first plane; and at least one starboard straight line. The starboard straight line of the hull lies on said starboard side of the first plane and intersects it at a point at or aft of said stern. A plurality of stations are located along at least one starboard straight line, with a station positioned between $\frac{2}{3}$ of the length $L_{lwl}$ of the hull and the bow. Each of the plurality of stations have an orthogonal line intersecting at least one starboard straight line, where the bottom surface forms the respective intersections, and a portion of the bottom surface proximate to the respective intersection is normal to the orthogonal line. In embodiments of the hull, each station's orthogonal line is co-planar with each of the other stations orthogonal line and the keel is symmetric with respect to the first plane.

It is still another object of the disclosed subject matter to present a novel improvement to a method of reducing the drag on a sailboat traveling on a body of water under the power of the wind. The sailboat having a fixed centerline and being at a angle of heel to the leeward. A novel improvement being passively inducing a keel angle of attack proportional to the angle of heel. The improved method includes providing a hull wherein the hull is symmetric with respect to a first plane defined by the centerline and perpendicular to a surface of the body of water when the heel angle $\phi$ is zero, providing a rigid keel with a zero lift line parallel to said centerline, and, providing at least one starboard path line, The starboard path line being parallel to the direction of travel while on a port tack at an angle $\lambda$ from the centerline and intersecting the first plane aft of the stern. The improvement also includes shaping a starboard side of the hull such that a portion of the starboard side proximate to a starboard plane is substantially symmetric with respect to the starboard plane, wherein the starboard plane is perpendicular to the surface of a body of water and includes at least one starboard path line when the hull is heeled to starboard.

It is yet another object of the disclosed subject matter to present a novel sailboat hull with a bow, a stern, a starboard side, a port side, and a keel. The hull defined by a longitudinal axis, a lateral axis, and a vertical axis Each of the axes is perpendicular to each of the other axes. Embodiments of the hull include a first plane defined by the longitudinal axis and vertical axis, a bottom surface symmetric with respect to the first plane and a secondary plane oblique to the first plane and intersecting the longitudinal axis at or aft of the stern and intersecting the bottom surface on the starboard side. The secondary plane in embodiments of the hull intersects the first plane at an angle $\Phi$ about the longitudinal axis and an angle $\Lambda$ about the vertical axis, where $\Phi$ and $\Lambda$ do not equal zero. In an embodiment of the hull, a starboard portion of the bottom surface of the hull proximate to the secondary plane is substantially symmetric with respect to the second plane; the starboard portion is longitudinally located at least between the mid-ship and bow, having a length of at least 10% of the hull length at the water line $L_{LWL}$.

The disclosed subject matter overcomes the deficiencies of the prior art by advantageously inducing a lateral force on the keel without generating a lateral force on the hull with its associated drag, thus providing a sailboat with reduced drag without resorting to the prior art methods and their associated disadvantages as described above. These and many other objects and advantages of the present invention will be readily apparent to one skilled in the art to which the invention pertains from a perusal or the claims, the appended drawings, and the following detailed description of the preferred embodiments.

DETAILED DESCRIPTION

Figure 1A:
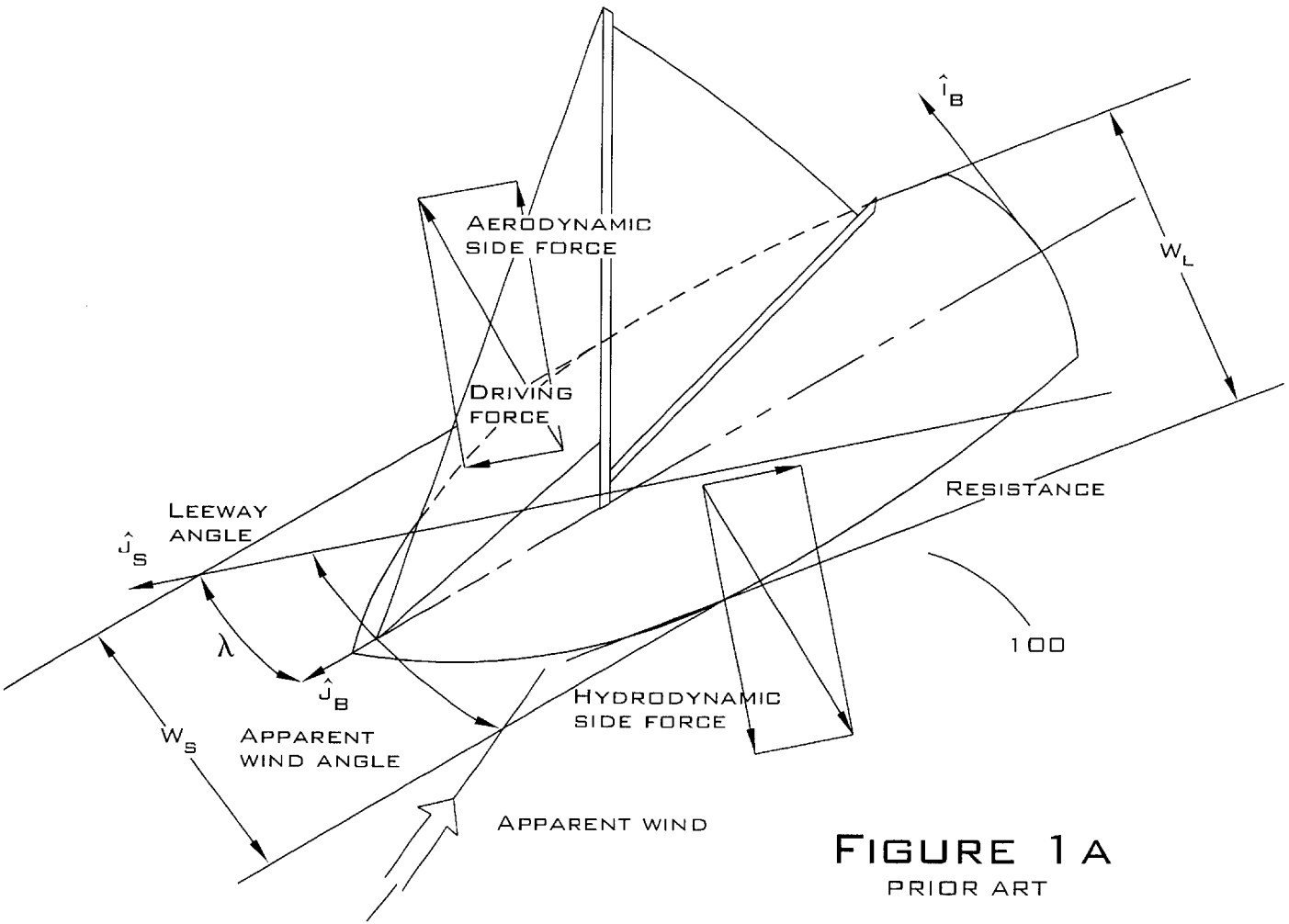
FIGURE 1A PRIOR ART
FIG. 1A is a plan view representation of the forces acting on a sailboat on a beat to windward.
Figure 1B:
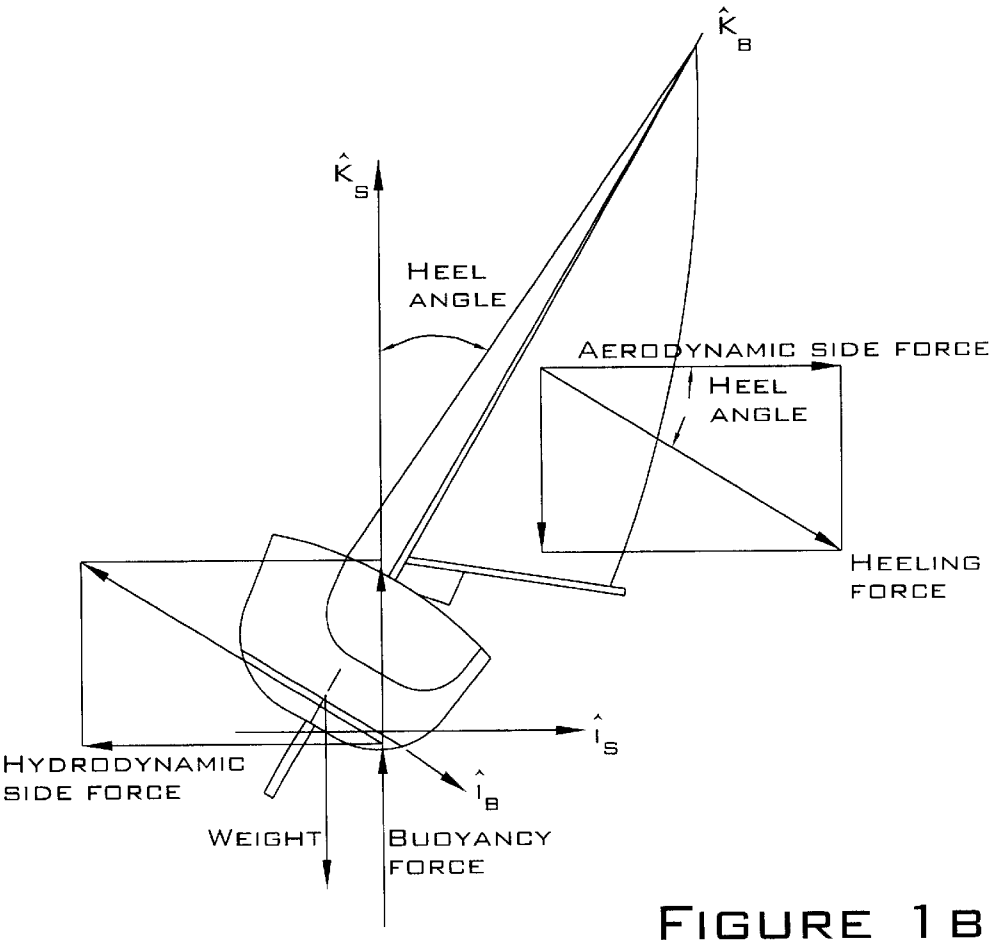
FIGURE 1B PRIOR ART
FIG. 1B is a rear view representation of the forces acting on a sailboat on a beat to windward.
Figure 2:
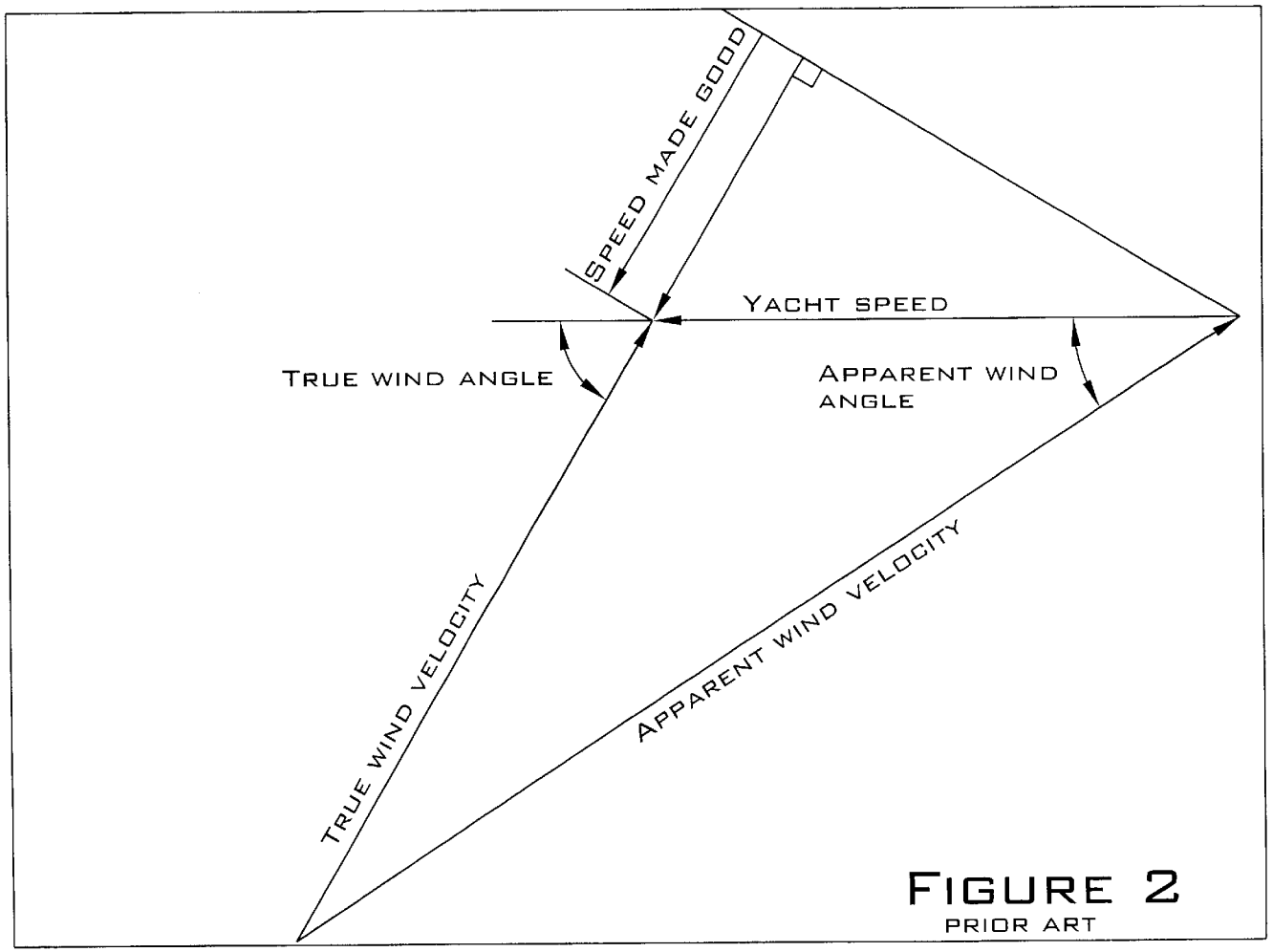
FIGURE 2 PRIOR ART
FIG. 2 is a representation of the velocity triangle as known in the prior art.
Figure 3:
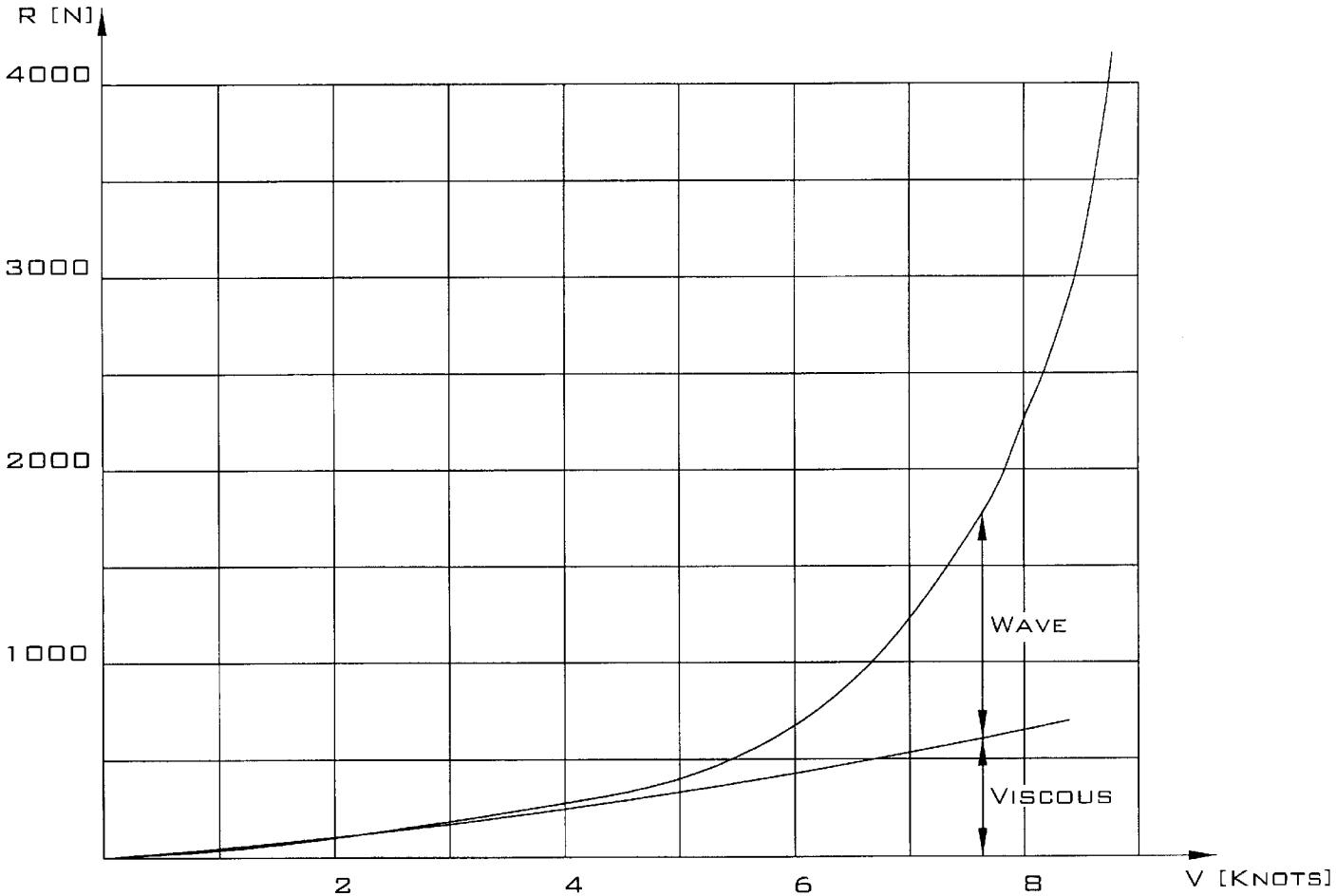
FIGURE 3 PRIOR ART
FIG. 3 is a representation of the resistance curve for a typical sailboat towed upright in smooth water at $\lambda=0$.
Figure 4:
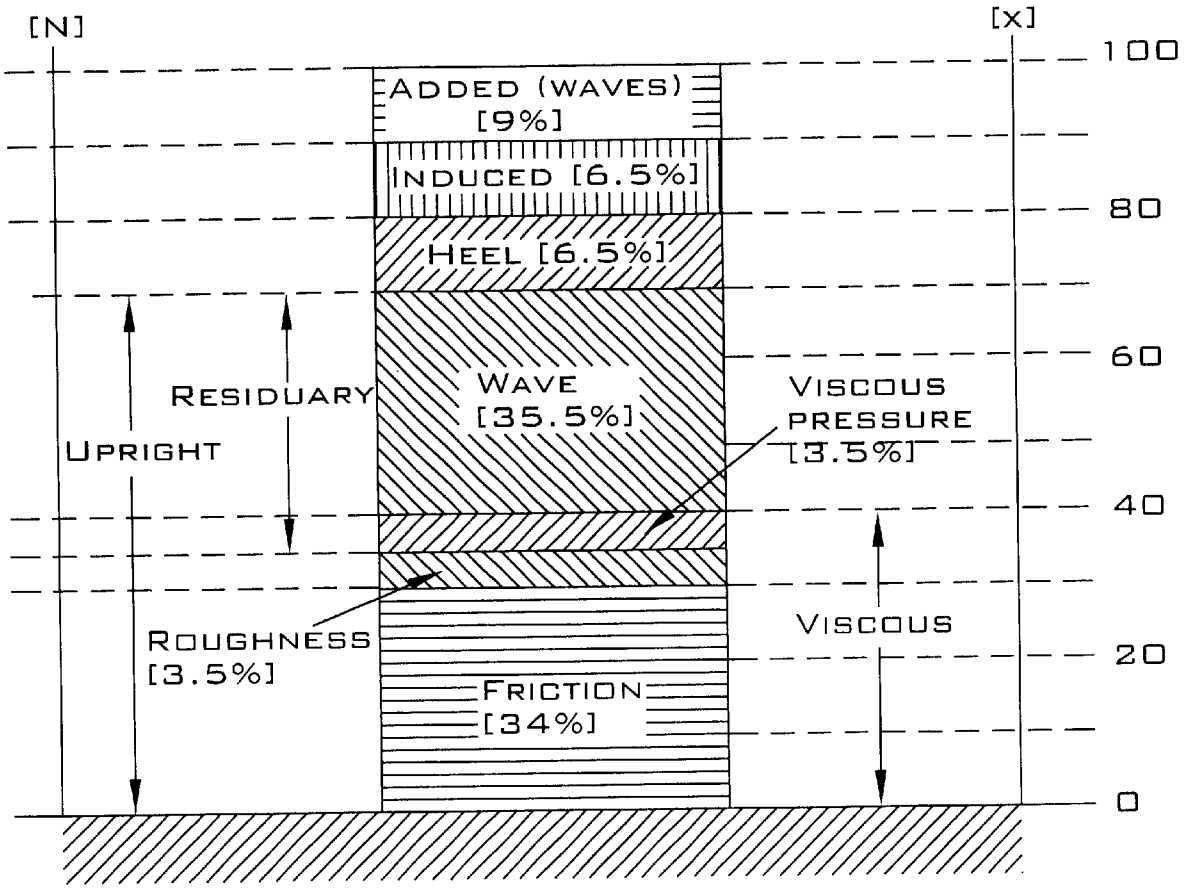
FIGURE 4 PRIOR ART
FIG. 4 is a representation of the resistance components of a typical sailboat on a beat to windward ($\lambda\neq0$).
Figure 5:
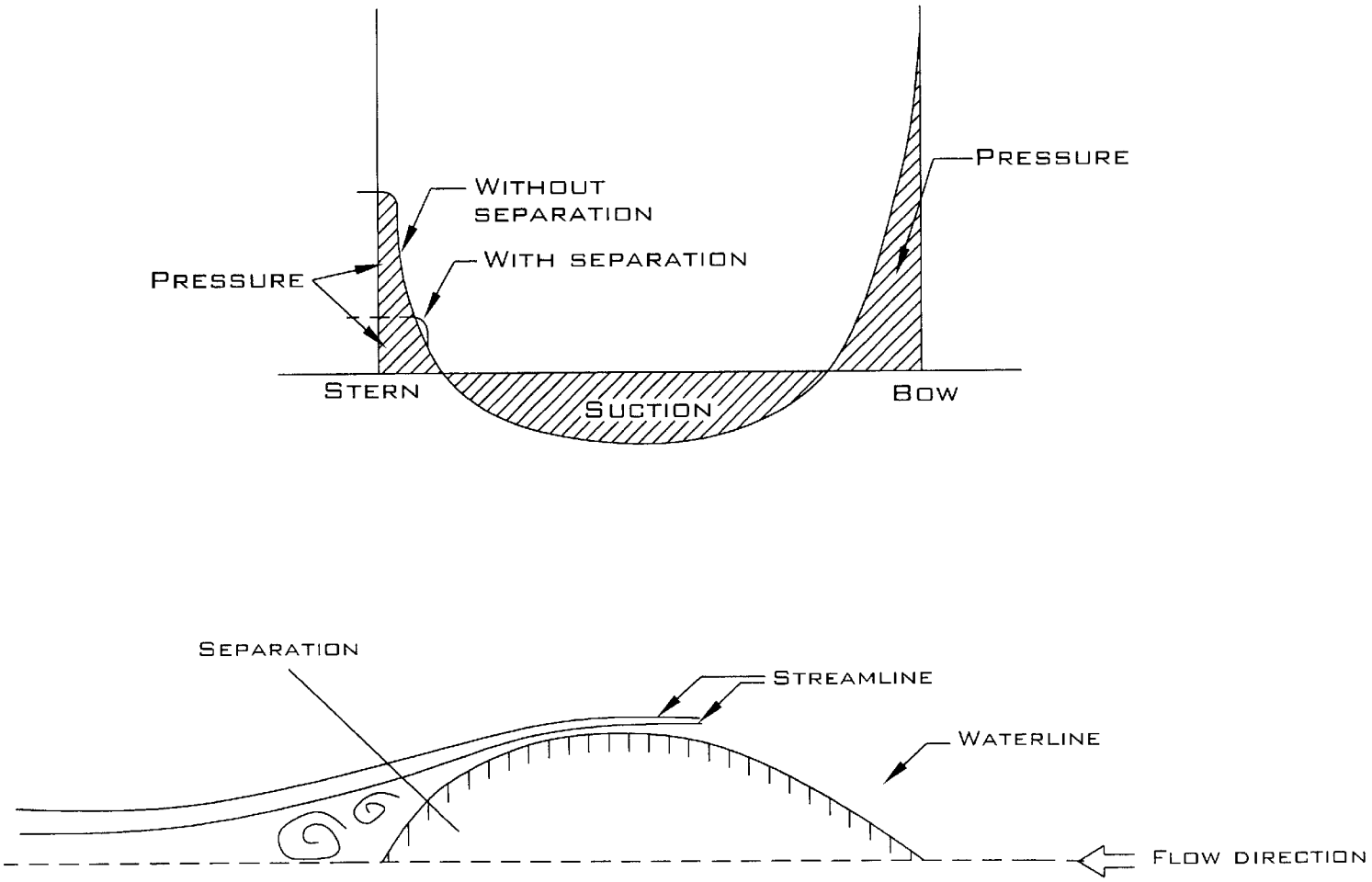
FIGURE 5 PRIOR ART
FIG. 5 is a representation of a pressure distribution and flow separation for a typical sailboat towed upright in smooth water at $\lambda=0$.
Figure 6A:
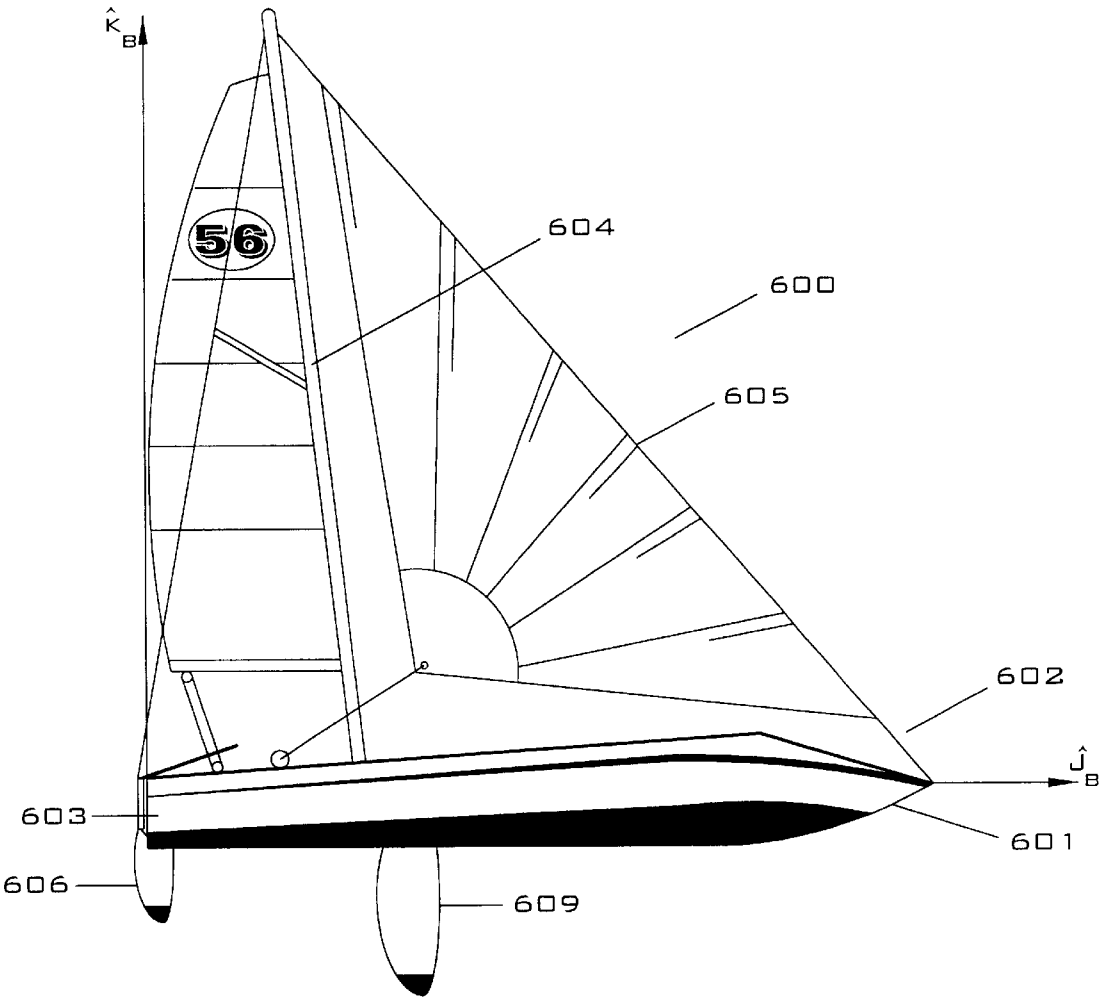
FIG. 6A is an elevation of a sailboat according to the disclosed subject matter.

FIG. 6*a* is a elevation view of a sailboat and associated hull 601 of an embodiment of the disclosed subject matter illustrating the bow 602, stern 603 and keels 609. A longitudinal axis $\hat{j}$ running from the stern 603 to the bow 602 is perpendicular to vertical axis $\hat{k}$. Left along the longitudinal axis towards the stern 603 is aft whereas right towards the bow 602 is forward. Mast 604, sails 605, rudder 606 and other miscellaneous sailboat components attach to the hull 601. In an envisioned embodiment of the subject matter of the disclosure, the mast 604 is stepped aft of midship, where the midship is approximately midway between the stern 603 and the bow 602. The longitudinal axis $\hat{j}$ and the vertical axis $\hat{k}$ define a first plane about which the bottom surface of the hull 601 is symmetric.

Figure 6B:
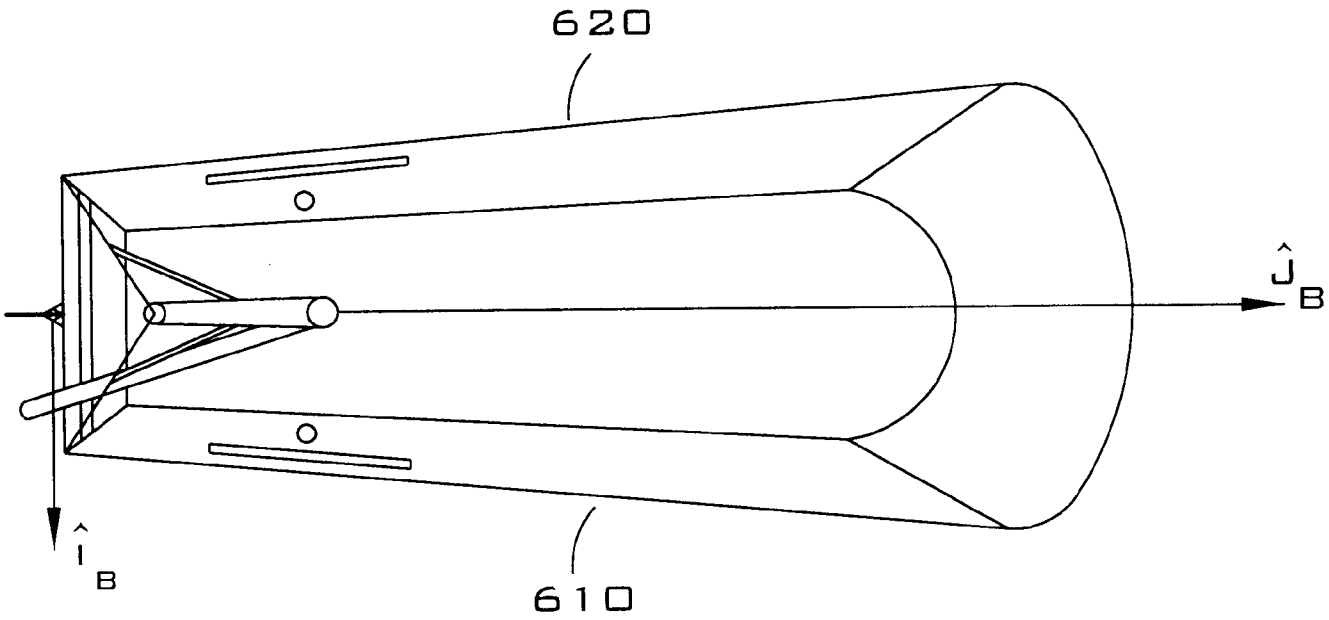
FIG. 6B is a plan view of the sailboat in FIG. 6A.

FIG. 6*b* is a top view of the sailboat and hull 601 of FIG. 6*a*. FIG. 6*b* illustrates the bow 602 and stern 603 along with the starboard 610 and port 620 sides of the hull 601. The starboard 610 and port 620 sides of the hull 601 are mirror images of each other with respect to the plane. The lateral axis $\hat{i}$ is perpendicular to both the longitudinal axis $\hat{j}$ and the vertical axis $\hat{k}$, again defining the boat reference frame $\overline{B}$.

Figure 6C:
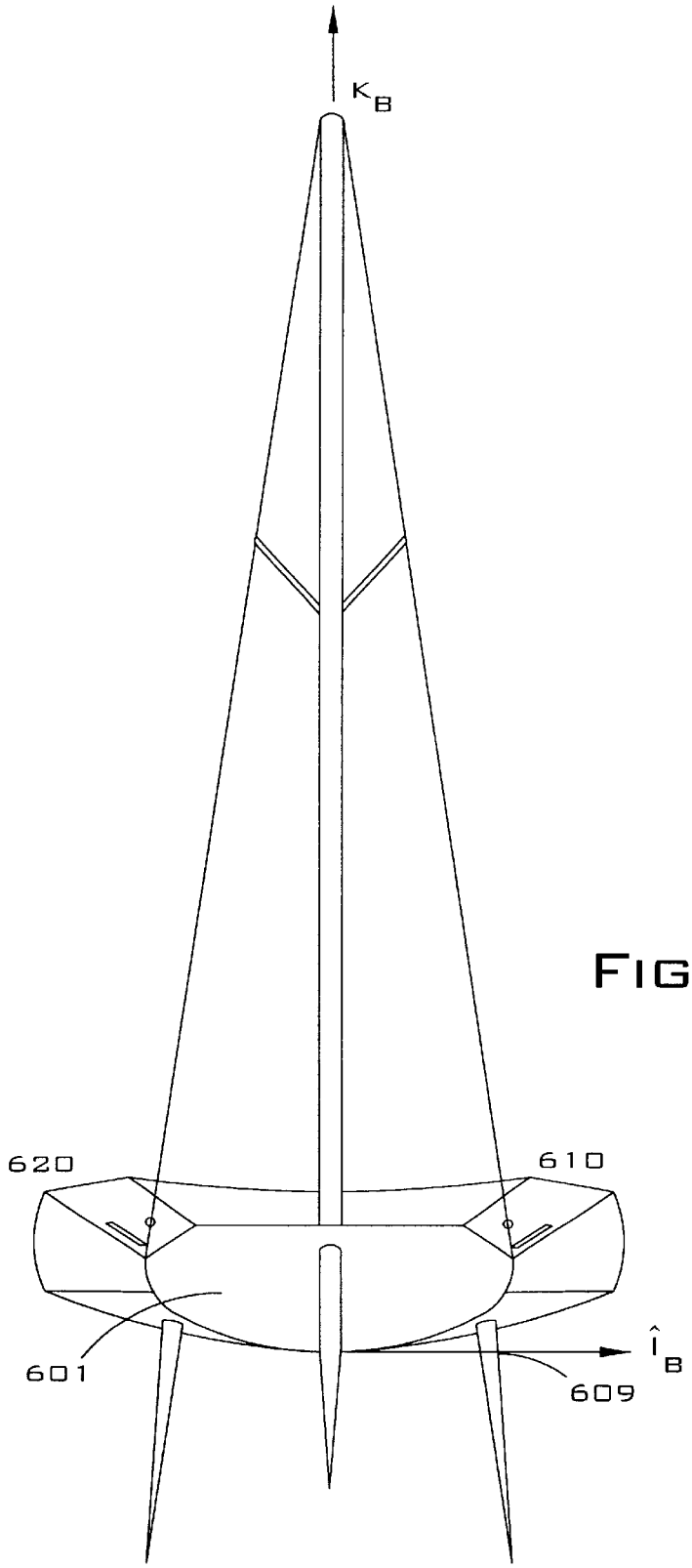
FIG. 6C is a rear view of the sailboat in FIGS. 6A and 6B.

FIG. 6*c* illustrates a rear view of the sailboat and hull 601 of the embodiment shown in FIGS. 6*a* and 6*b*. The starboard 610 and port 620 portion of the hull 601 are seen again to be symmetrical with respect to the first plane defined by the longitudinal $\hat{j}$ and vertical axis $\hat{k}$. Two fin keels 609 in the present embodiment are also symmetric about the first plane.

The hull 601 of an embodiment shown in FIG. 6*a*–6*c* is defined in reference to the first plane that is normal to the lateral axis $\hat{i}$ and containing the longitudinal axis $\hat{j}$ or as described previously, the hull is defined in reference to the plane defined by the vertical k axis and the longitudinal axis $\hat{j}$.

Embodiments of the hull are herein described almost exclusively by the description of the starboard side, however it should be understood that the hull embodiments are symmetric with respect to the first plane (i.e. the port side of the hull and attached keel are a mirror image of the starboard side with respect to the first plane).

The starboard side of the hull lies on the positive side of the first plane with respect to the lateral axis $\hat{i}$. The bottom surface of the hull is the surface which defines the separation or boundary between the substantially rigid hull and the fluid medium in which the hull operates (e.g. water and air).

Figure 7A:
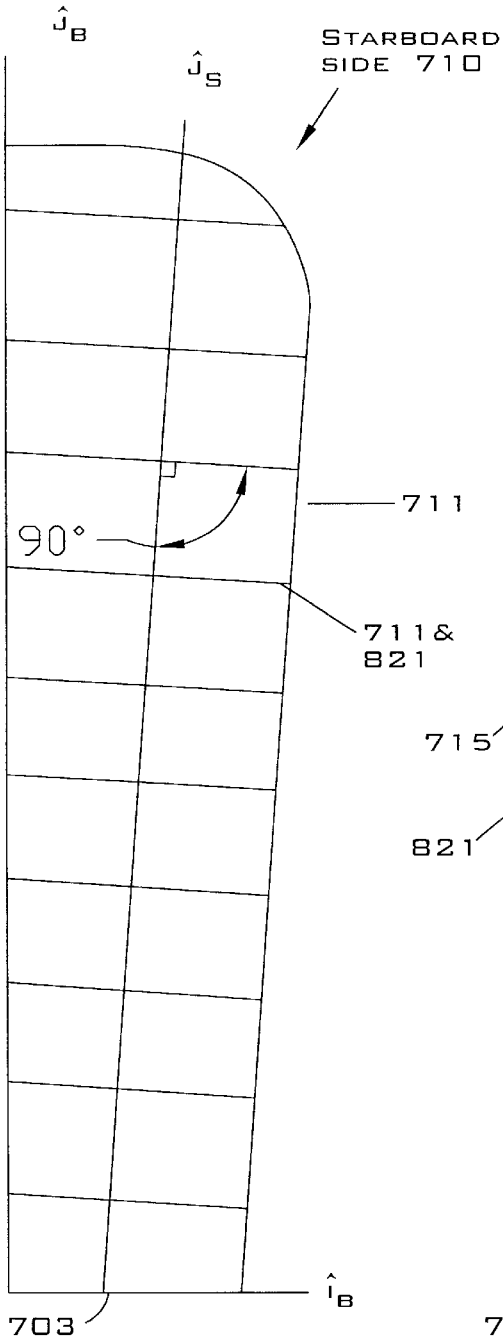
FIGS. 7A and 7B are starboard sides of a hull, according to the disclosed subject matter.

FIG. 7*a* shows the starboard side of an embodiment of the hull. The starboard side of FIG. 7*a* contains a Starboard Straight Line (SSL) 711. The SSL 711 is a line in the classical Euclidian sense and as such does not necessarily have a physical manifestation. The SSL 711 intersects the first plane at a point (not shown) with a vertical projection onto a horizontal plane, defined by the lateral axis $\hat{i}$ and the longitudinal axis $\hat{j}$, located aft of, or proximate to, the stern 703. For purposes of this disclosure a position aft of another position is a position where the $\hat{j}$ coordinate is less than the $\hat{j}$ coordinate of the other position. A position forward has a greater $\hat{j}$ coordinate.

Figure 8:
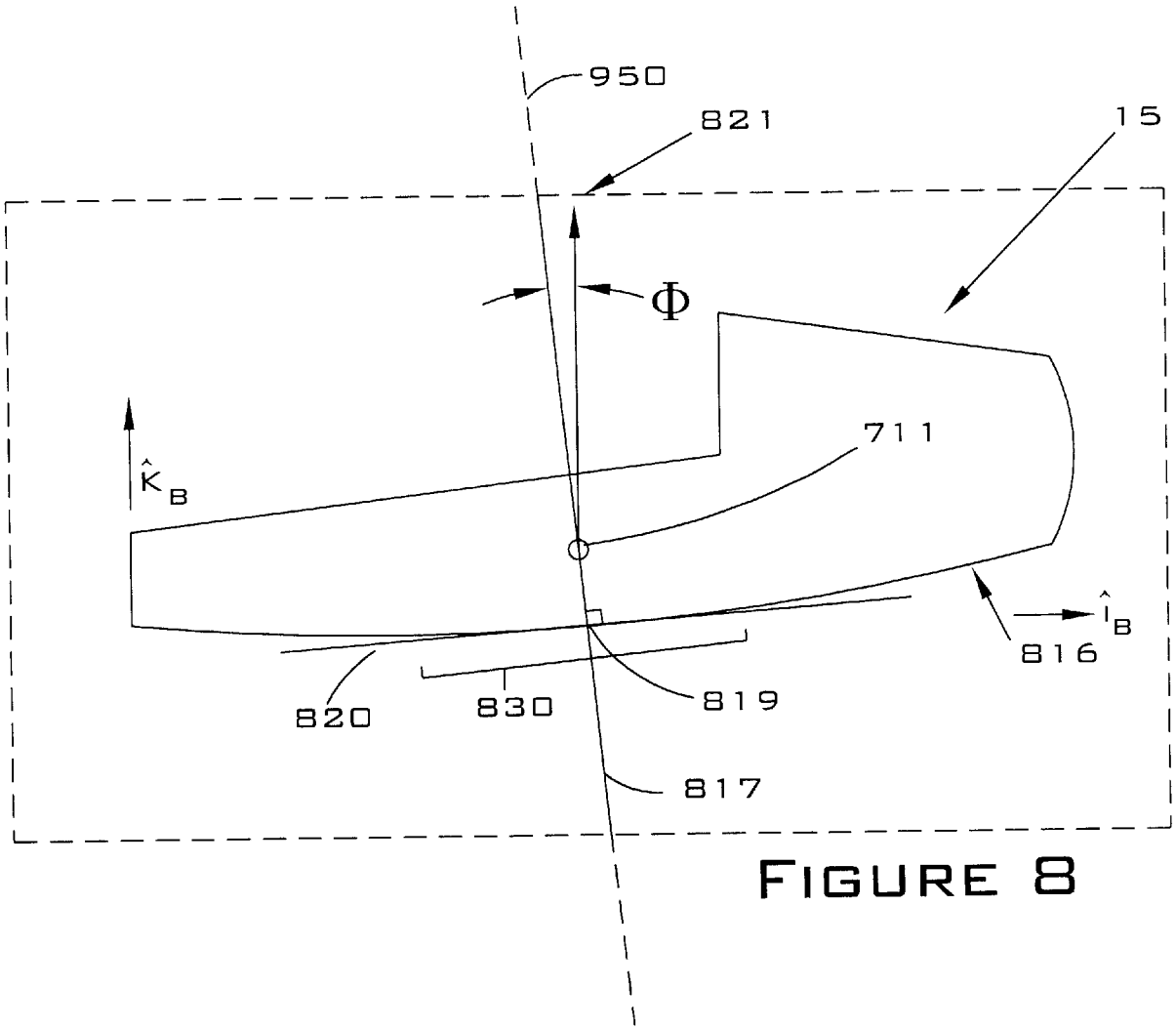
FIG. 8 is a representation of a starboard cross section, according to the disclosed subject matter.

A plurality of starboard cross sections 715 are located along the SSL 711. The starboard cross sections 715 are co planer with their respective cutting planes 821 which define the bottom surface of the hull via their intersection on the starboard side. The intersection of the two surfaces, the cutting plane 821 and the hull as shown in FIG. 8, defines a hull contour 816 which is a two dimensional curve in the cutting plane 821 and is a portion of the starboard cross section 715. The starboard cross section 715 also contains an orthogonal line. The orthogonal line (OL 817) intersects the SSL 711 within the cutting plane 821 and the hull contour 816. At the intersection point 819 of the OL 817 and the hull contour 816 is a line 820 tangent to the hull contour 816 and containing the intersection point 819. The OL 817 is perpendicular to this tangent line 820. The portion 830 of the hull contour 816 proximate to the OL 817 is symmetric with respect to the OL 817. The expanse of the symmetric portion 830 of the hull contour 816 can be a small fraction of the hull beam measured at the respective starboard cross section, where there are multiple SSL 711, or can be a substantial fraction of the respective beam such as ¼ where the embodiment has only one SSL 711. Rarely would the expanse of the proximate portion 830 be greater than ½ the hull beam, however, it should be understood that these particular ranges of the symmetric expanse is not intended to limit the application of the disclosed subject matter, but rather provide general rules of thumb.

Numerous starboard cross sections 715 ranging from 2 to ∞ are envisioned for defining a respective hull contour 816 and thus the bottom surface of the hull 601. As separation delay is important to the reduction of drag as discussed previously, it is most advantageous that at least the forward portion of the hull 601 be shaped with the described starboard cross sections 715. The aft portion of the hull also benefits from the shape described by the starboard cross section but to a lesser degree than the forward portion since separation and turbulent flow are usually already developed. As such for other considerations, such as buoyancy, planning ability or cockpit volume, it may be advantageous that the shape of the hull 601 in the aft portion be other than the shape produced by the application of the starboard cross sections 715. Therefore it is preferable that at least one of the starboard cross sections 715 be located between $\frac{1}{2}^{rds}$ of the hull length at the waterline $L_{lwl}$ and the bow 602 of the hull 601.

Figure 9A:
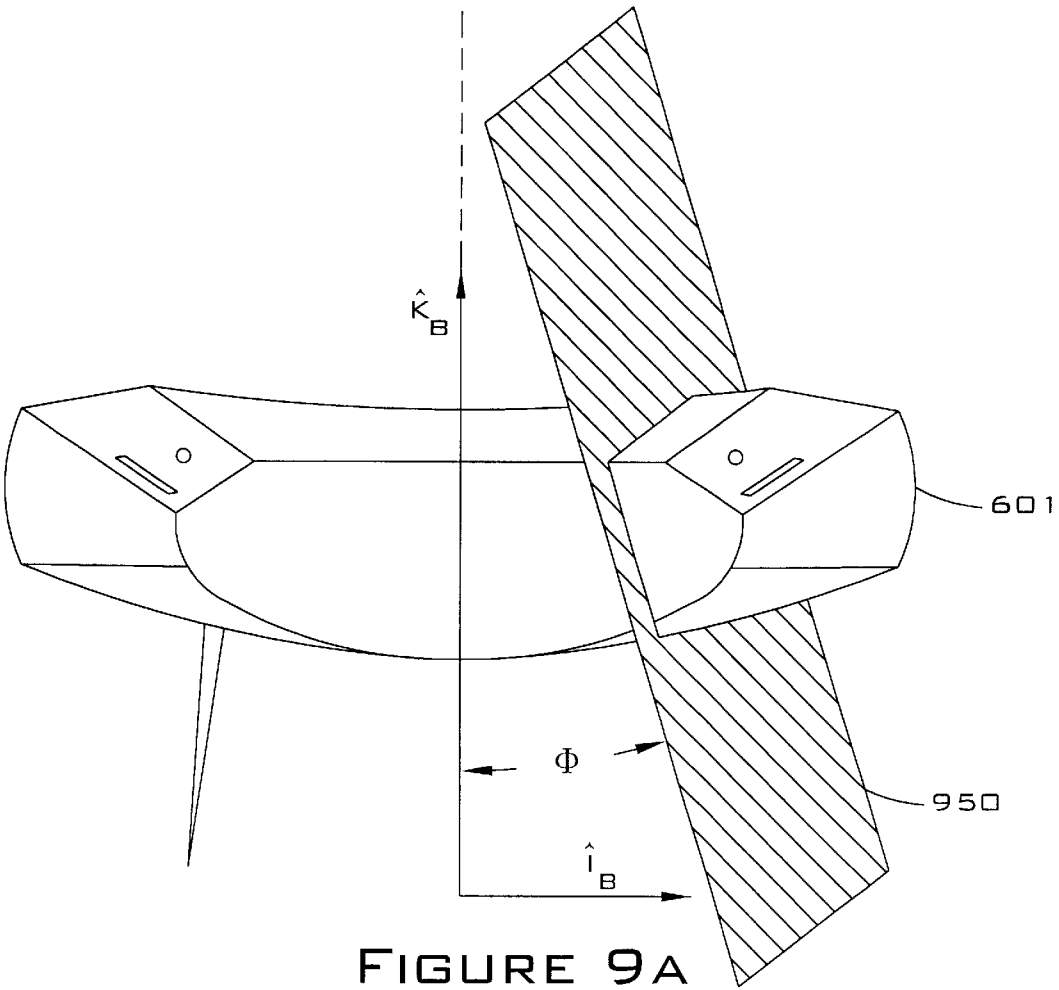
FIG. 9A is a representation of a secondary plane as viewed from the stem, according to the disclosed subject matter.
Figure 9B:
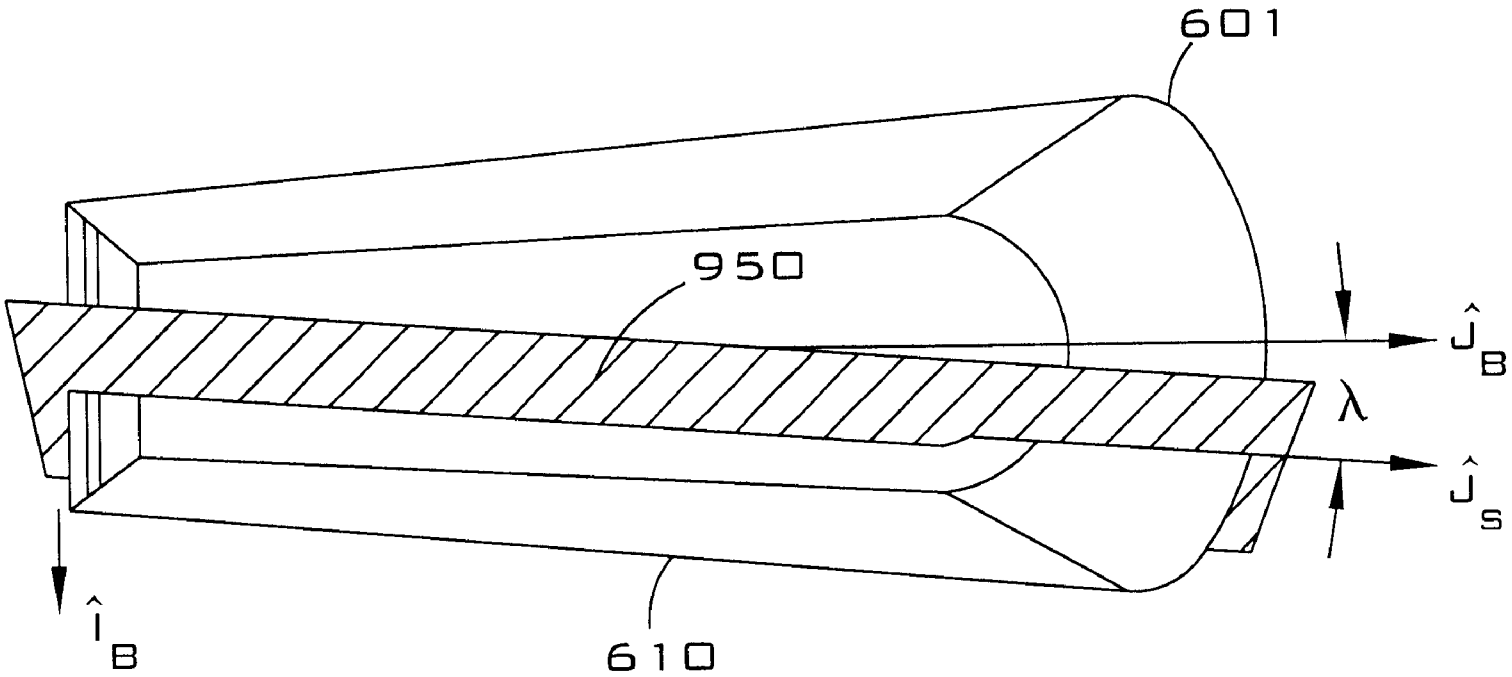
FIG. 9B is a representation of a secondary plane as viewed from the top, according to disclosed subject matter.

The OL 817 intersecting a corresponding SSL 711 define a respective secondary plane 950 that includes the SSL 711 as shown in FIG. 9*a*, all of the OLs 817 which intersect the same SSL 711 are contained in the respective secondary plane 950. The secondary plane 950 intersects the first plane about the longitudinal axis $\hat{j}$ at an angle Φ, and intersects the first plane about the vertical axis $\hat{k}$ at the same angle λ as does the SSL 711. Since the angle Φ corresponds to a design heel angle $\phi_d$ for the hull, the angle Φ is limited to less than 90°, as the driving force of the sails is a function of f(cosϕ). As $\phi_d$ and thus Φ approach 90°, the driving force approaches 0, and more importantly the boat is essentially in a capsized state. Thus, a realistic maximum for Φ is approximately 60°, a point where the sail area projection and thus driving force are reduced by half and it is still possible to maintain the crew in the cockpit of the boat.

Figure 7B:
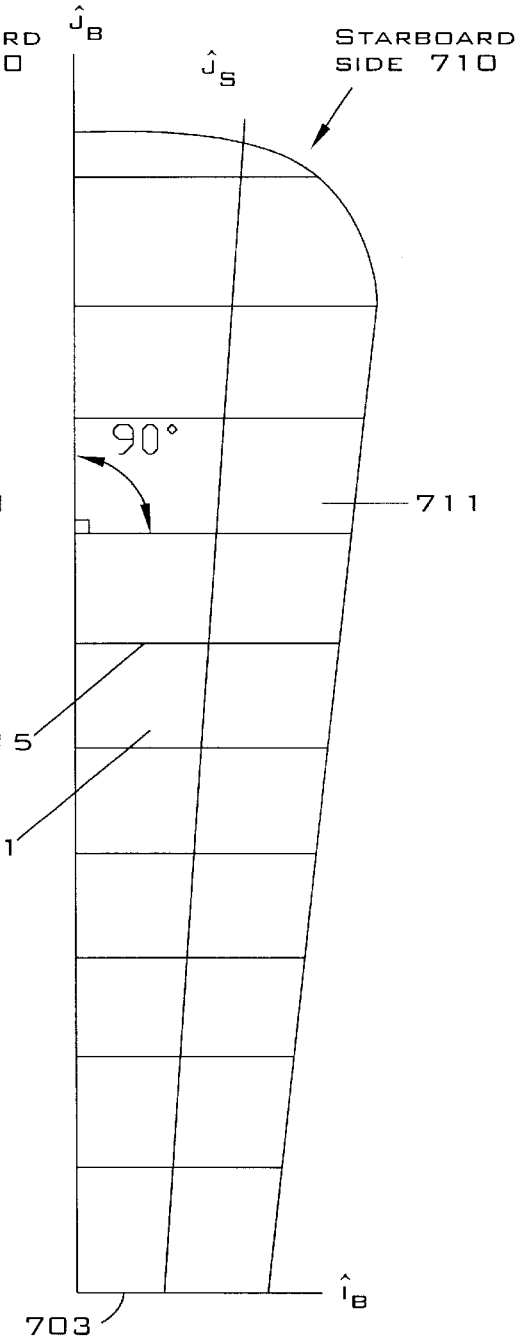
Figure 10C:
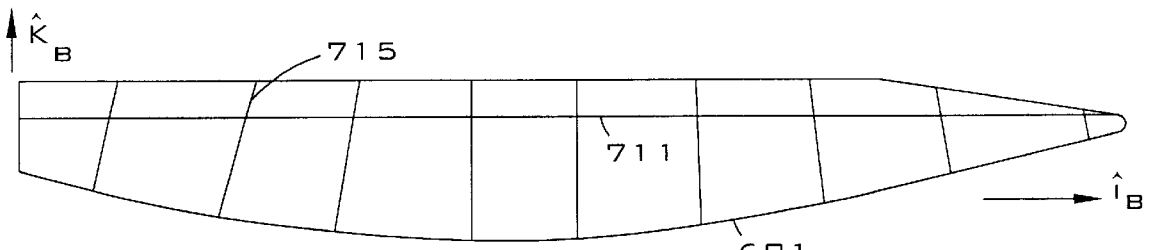
FIG. 10C is an elevation view of an embodiment of a disclosed hull, where the cutting planes or starboard cross sections are not parallel.
Figure 10B:
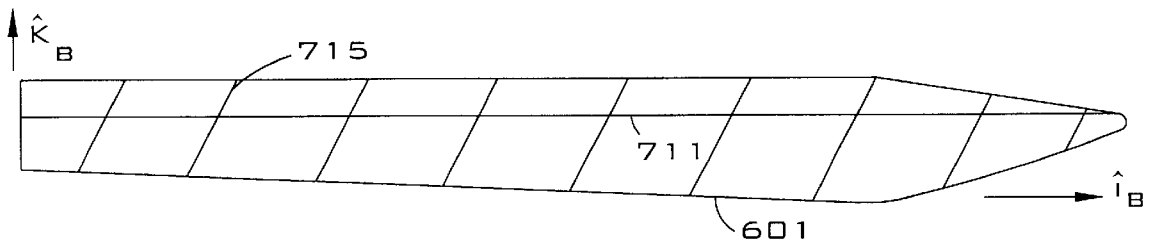
FIG. 10B is an elevation view of an embodiment of the hull, where the cutting planes or starboard cross sections are each parallel and they are not normal to a SSL or the longitudinal axis.
Figure 10A:
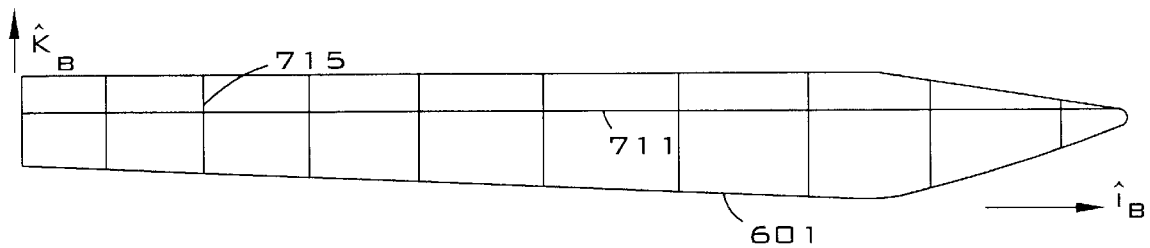
FIG. 10A is an elevation view of an embodiment of a disclosed hull where the cuttings or starboard cross sections are each parallel and the cutting planes or starboard cross sections are normal to either a starboard straight line or longitudinal axis.

As seen in FIG. 7*b*, the cutting planes 821 intersect the first plane about the vertical axis $\hat{k}$ at an oblique angle. This orientation aligns the cross sections 715 perpendicular to the direction of travel thru the water or perpendicular to the $\hat{i}_S$ axis. In FIG. 7*b*, the cutting planes 821 intersect the first plane about the vertical axis at 90°. In contrast to the cutting planes 821 of FIG. 7*a*, the cutting planes 821 of FIG. 7*b* do not intersect the lateral axis $\hat{i}$. The cutting planes 821 in both FIGS. 7*a* and 7*b* can intercept the vertical axis $\hat{k}$ as shown in FIG. 10*b*, not intercect the vertical axis as shown in FIG. 10*a*, or intersect the vertical axis as shown in FIG. 10*c*. The cutting planes may or may not intersect the vertical axis In FIG. 10*a* the cutting planes 821 are normal to the respective SSL 711. In either case, the hull remains symmetric about the first plane and the portion 830 proximate to the orthogonal lines remain symmetric about the respective secondary plane.

Another embodiment of the disclosed hull is defined by stations, rather than cross sections along a SSL 711. The OLs intersect the SSL 711 at a plurality of stations and intersect the bottom surface of the hull. At this intersection, the bottom surface of the hull proximate to the intersection is normal to the respective OL. All the OLs associated with a particular SSL 711 are co-planer with each other in a secondary plane. Again for reasons described earlier at least a portion of the bottom surface proximate to the intersection is located in the forward portion of the hull between $\frac{2}{3}^{rds}$ of the length of the hull $L_{lwl}$ and the bow.

Figure 13:
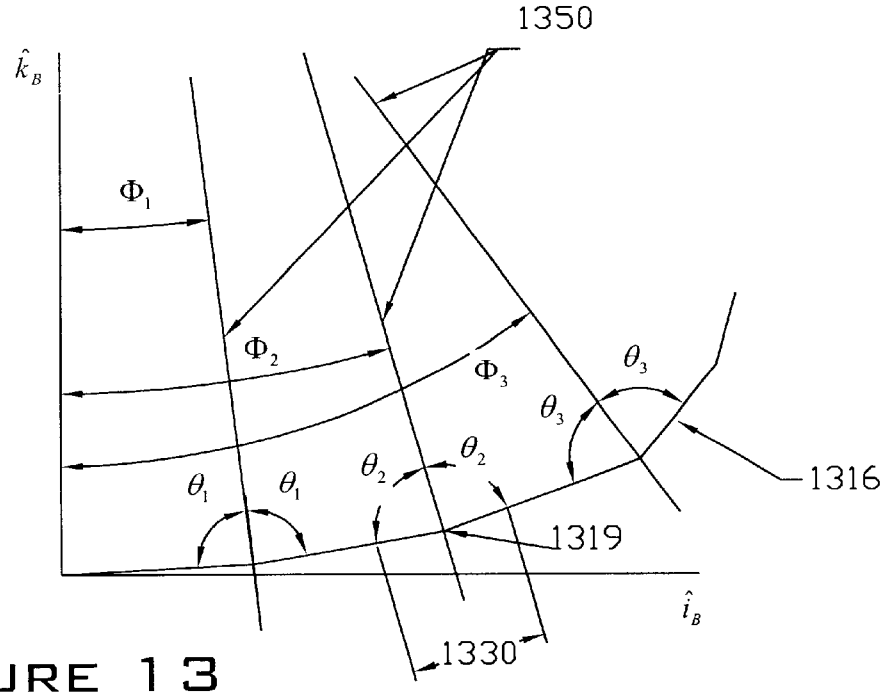
FIG. 13 is a cross sectional view of a starboard hull according to the disclosed subject matter

An embodiment of the hull as shown in FIG. 13, uses one or more secondary planes on the starboard side that intersect the first plane at an angle Φ about the longitudinal axis $\hat{j}$ and intersects at an angle λ about the vertical axis $\hat{k}$, where for Φ≠0, λ≠0. The secondary plane 1350 intersects the bottom surface 1316 defining a starboard portion 1330 that is proximate to the intersection 1319 of the respective secondary plane 1350 and the bottom surface. The starboard portion 1330 is symmetric with respect to the secondary plane. The starboard portion 1330 is preferably a substantial length along the hull, but at least a length of 10% of the hull length $L_{lwl}$ and is located preferably at least between midship and the bow of the hull.

FIG. 13 shows a plurality of secondary planes 1350 and a plurality of corresponding starboard portions 1330. Each of the secondary planes 1350 are oblique to the first plane and each of the other secondary planes. In addition each secondary plane intersects the longitudinal axis at or aft of the stern, and intersects the bottom surface on the starboard side. For each secondary plane a corresponding starboard portion is substantially symmetric with respect to the secondary plane. The respective starboard portion's expanse laterally ranges from less then ½ of the beam where only one secondary plane is used to define the hull, to much less than ½ of the beam where several secondary planes are used to define the hull. The starboard portion of the hull while being symmetric about the respective secondary plane, can be in the form of a smoothly contoured surface or can be an angled surface with the intersection of the secondary plane bisecting;a vertex formed by the starboard portion. In the latter case the angles between the starboard portion and the secondary plane, $\theta_1$ and $\theta_2$, would be equal ($\theta_1 = \theta_2$) on both sides of the secondary plane 1350 as shown in FIG. 13. The secondary planes have angle Φ and Λ, defined as ($\Phi_i$, $\Lambda_i$), where i equals 1 to the number of secondary planes, and represents the $i^{th}$ secondary plane. Each secondary plane

1350 has a unique set of ($\Phi_i$, $\Lambda_i$). A third parameter $\gamma$ is the ratio of $\Lambda_i/\Phi_i$, which has a range of 0.01 to 2. However, as hydrofoils generally stall at angles greater than 20°, an $\Lambda$ over 20° would not be advantageous.

Figure 11A:
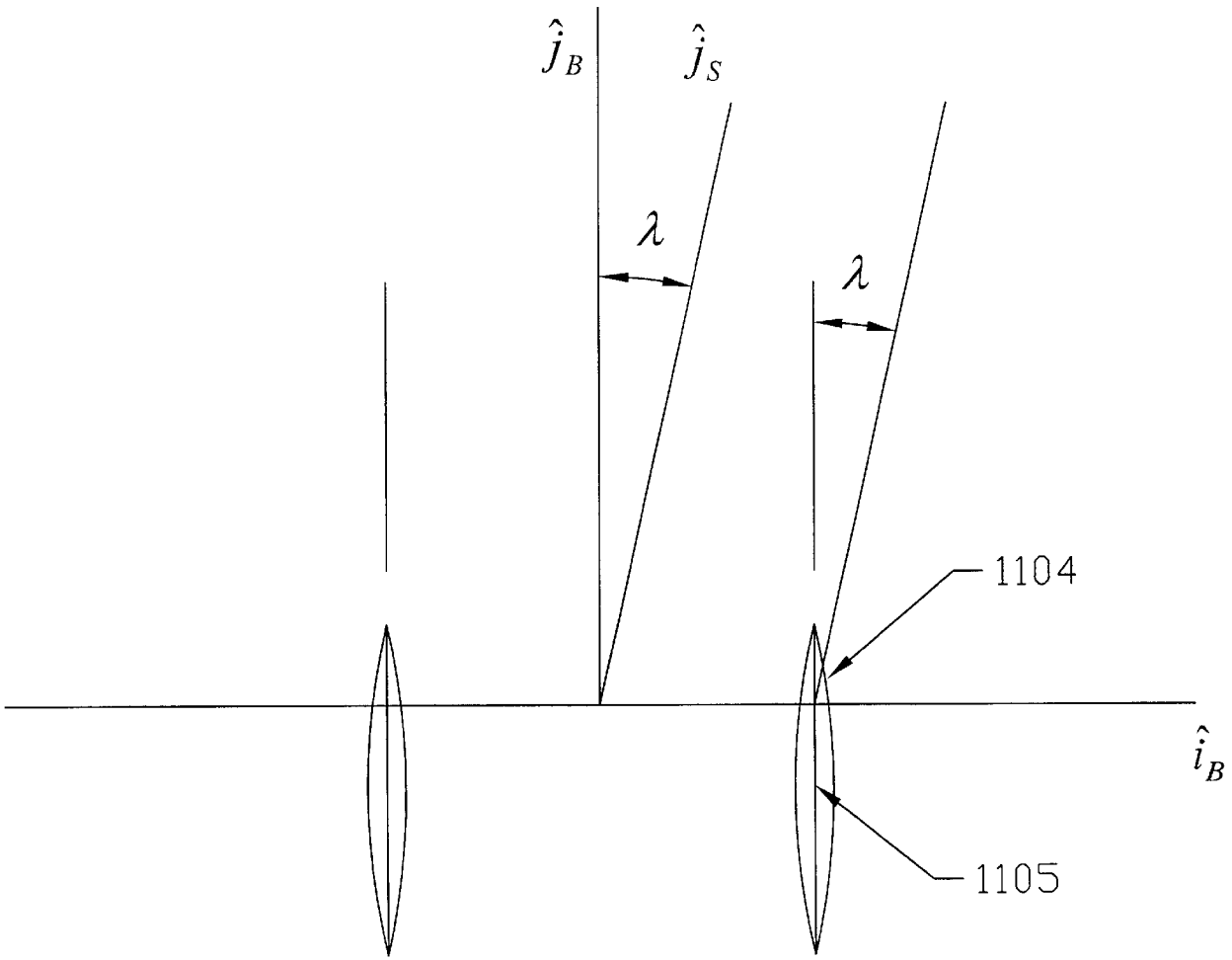
FIGS. 11A–11C are representations of different fin keel arrangements according to the disclosed subject matter.
Figure 11B:
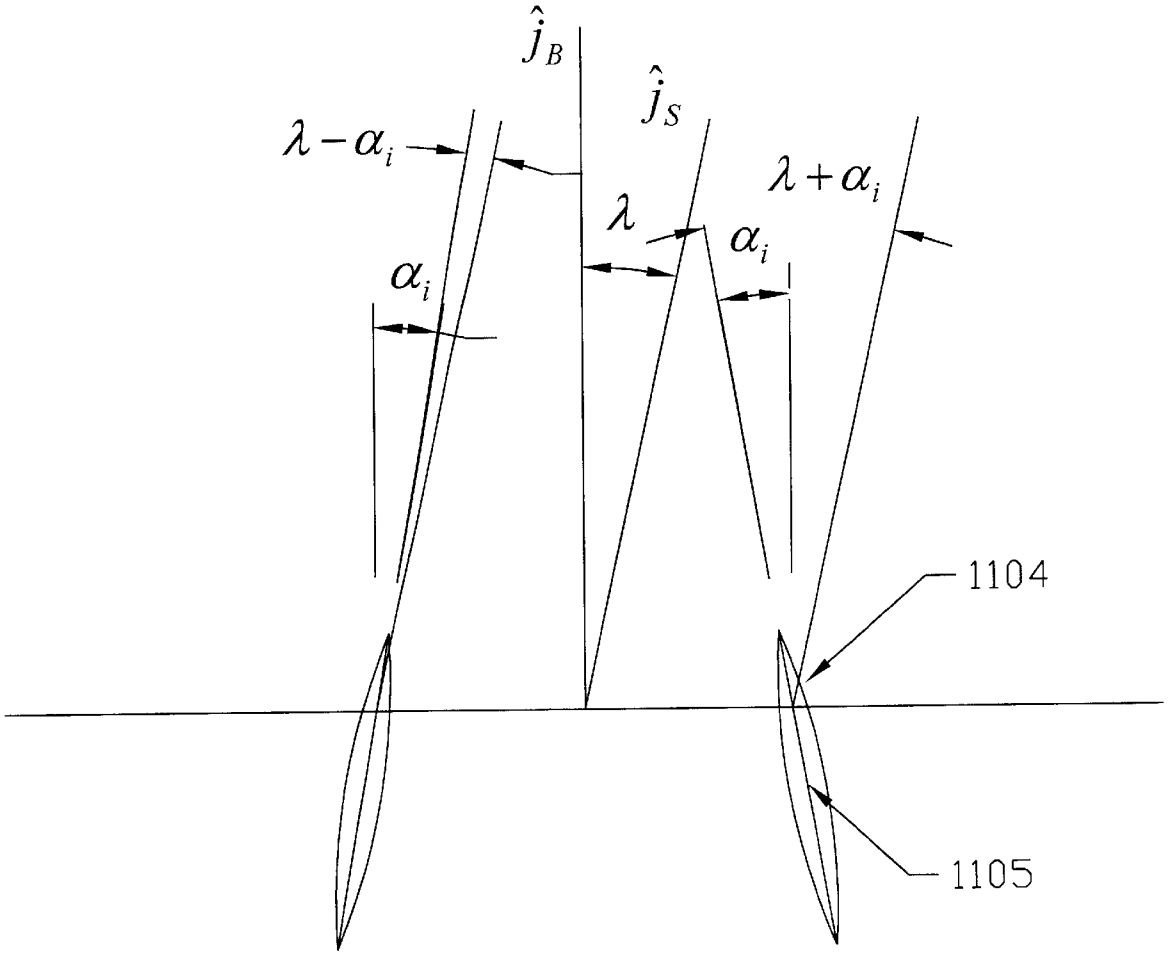
Figure 11C:
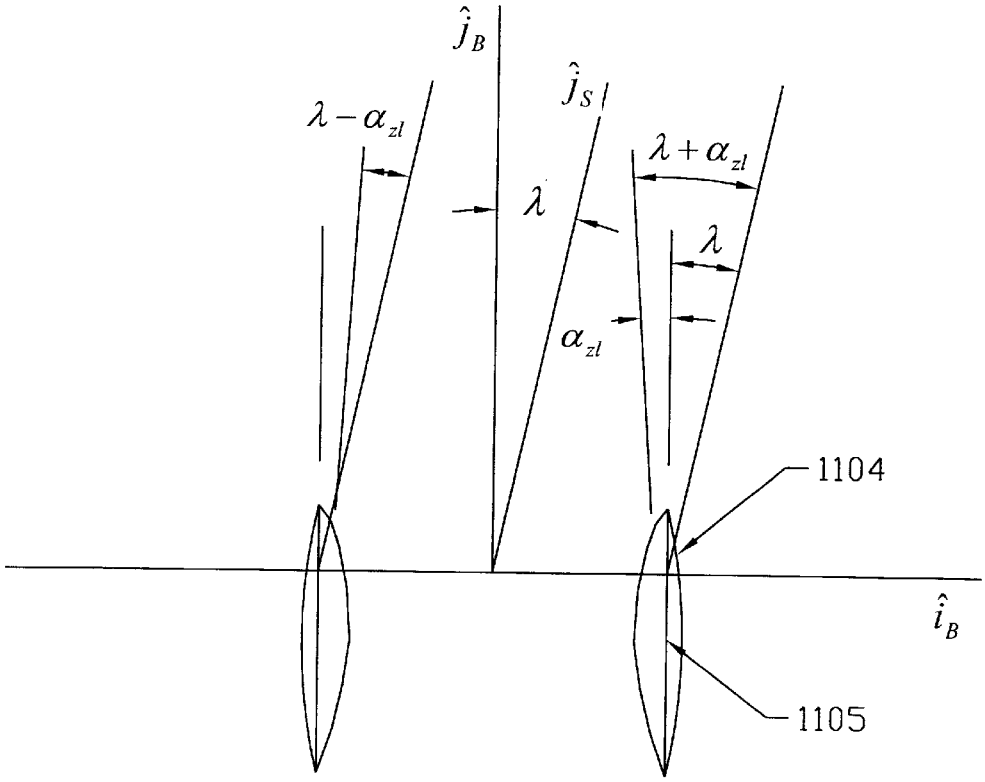

The embodiment of the hull in FIG. 6 shows two fin keels. The fin keels as a part of the hull are symmetric with respect to the first plane which contains the $\hat{i}$ axis. FIG. 11*a* shows an arrangement of two symmetric hydrofoils 1104, the center cord 1105 which for a symmetric hydrofoil is equivalent to the zero lift line. The zero lift lines for both the fin keels are parallel with each other and the I axis, such that the angle of attack $\alpha$, as seen by the hydrofoil is approximately $\lambda$, thus the net lateral, or lift force developed by the fin keels is a function of $\lambda$. FIG. 11*b* shows an embodiment of the fin keels wherein each of the hydrofoils 1104 has an angle of incident $\alpha_i$ with respect to the axis j. This results in the net lateral force or lift being a function of $\lambda$ in the similar manner as described above however the lateral force on each of the fin keels is a function of ($\lambda-\alpha_i$) or ($\lambda+\alpha_i$). This concentrates the lateral. force on the leeward fin which is advantageous in many respects, however the down wind drag resistance in this configuration is increased. Similarly in FIG. 11*c* the hydrofoils are asymmetric, thus resulting in a zero lift line not parallel to the center cord 1105, the angle between the two being $\alpha_{zl}$, 1 Thus the net lift generated by the arrangement of 11*c* is a function of $\lambda$, however the lift generated by a single fin keel is a function of ($\lambda-\alpha_{zl}$) or ($\lambda-\alpha_{zl}$). An advantage of using asymmetric hydrofoils is that the drag force can be minimized over a range of $\lambda$ while maximizing the lateral force over the same range, due to a bucket in the drag profile that is commonly attributed to asymmetric hydrofoils.

Figure 12:
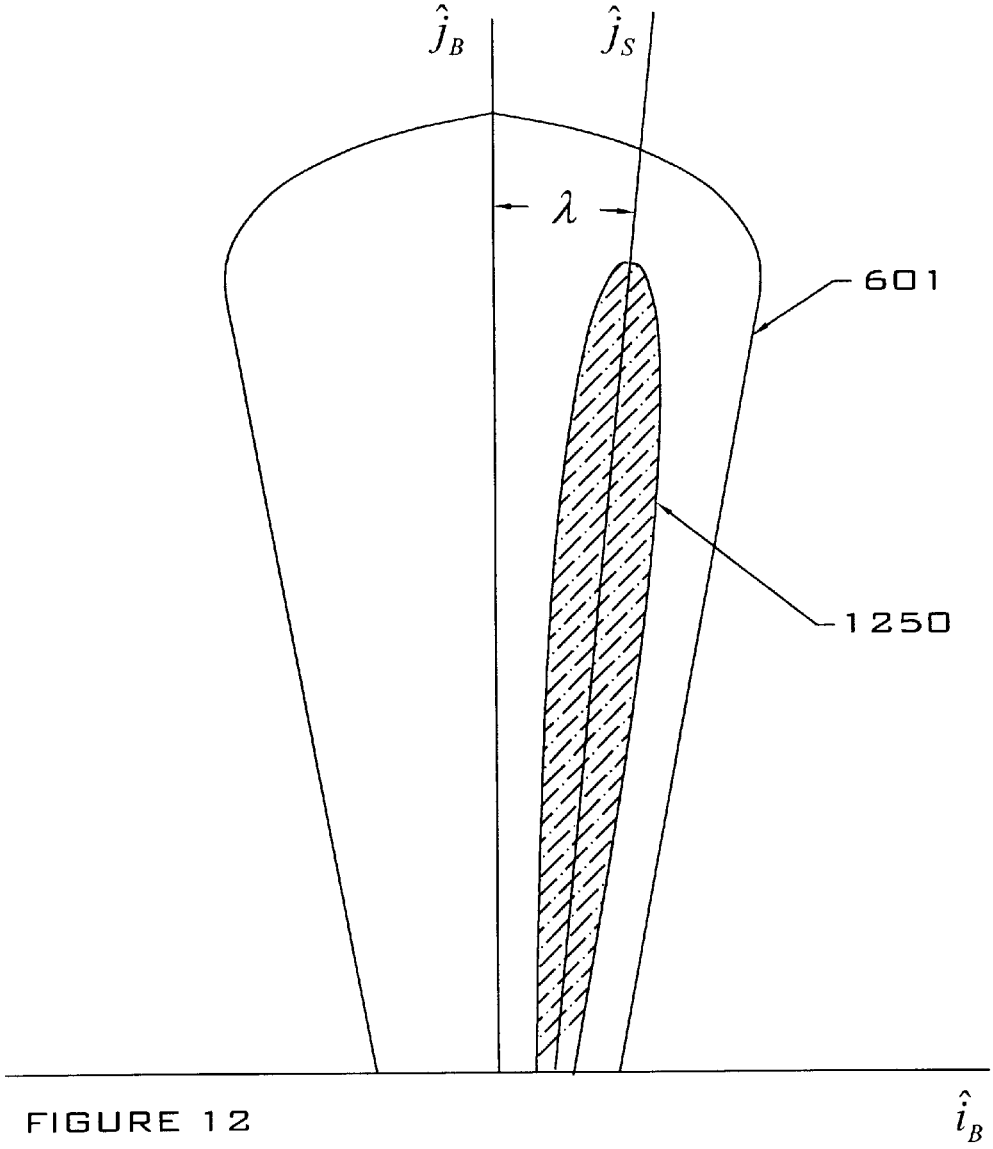
FIG. 12 is a representation of the water contour on an embodiment of a disclosed hull.

FIG. 12 shows a hull according to an embodiment of the subject matter, with an associated water plane outline. The water plane outline is defined by the intersection of a plane representing the surface of a body of water in which the sailboat rests and the hull of the boat. As shown n FIG. 12, the water plane outline is substantially symmetric about the secondary plane. More importantly the velocity distribution and thus the subsequent drag force across the submerged portion of the hull beneath the water plane has no net force component in the $\hat{i}_S$ direction thus when the surface is integrated, the resultant force F across the submerged hull has no component in the $\hat{i}_S$ direction so that $$\bar{F}\cdot\hat{i}_s = \oiint \vec{f}\cdot\hat{i}_s dA \cong 0.$$

Therefore no lift and thus no increase in drag due to lift is experienced on the hull, all the lateral force or lift is derived from the keel or keels which can be optimized for this function.

While preferred embodiments of the present invention have been described, it is to be understood that the embodiments described are illustrative only and that the scope of the invention is to be defined solely by the appended claims when accorded a full range of equivalence, many variations and modifications naturally occurring to those of skill in the art from a perusal thereof.

What is claimed is:

1. A sailboat hull with a bow, a stem, a starboard side, a port side, a keel, a longitudinal axis, a lateral axis, and a vertical axis, where each of said axes is perpendicular to each of the other axes, comprising:

a first plane defined by said longitudinal axis and said vertical axis;

a bottom surface, said bottom surface being symmetric with respect to said first plane;

at least one starboard straight line;

wherein said at least one starboard straight line lies on said starboard side of said first plane;

wherein said at least one starboard straight line intersects said first plane at a point, where in a projection of said point on to a horizontal plane, defined by the lateral axis and the longitudinal axis, is proximate to or aft of said stern;

a plurality of starboard cross sections located along said at least one starboard straight line; each of said plurality of starboard cross sections comprising:

a hull contour defined by the intersection of one of a plurality of cutting planes and said bottom surface on said starboard side;

an orthogonal line, said orthogonal line perpendicular to a line tangent to said hull contour, and intersecting said at least one starboard straight line, and said orthogonal line within the respective one of the plurality of cutting planes; and, wherein a portion of said hull contour proximate to said orthogonal line is symmetric with respect to said orthogonal line;

wherein at least one of said plurality of starboard cross sections is located between $^2/_3{}^{rds}$ of the hull length $L_{lwl}$ and the bow of the hull; and, wherein said keel is symmetric with respect to said first plane.

2. The hull of claim 1, wherein each of the orthogonal lines intersecting one of the at least one starboard straight line are in a respective secondary plane with each of the other orthogonal lines intersecting the same one of the at least one starboard straight line.

3. The hull of claim 2, wherein the secondary plane intersects the first plane about the longitudinal axis at an angle $\Phi$, where $0\neq\Phi<60°$.

4. The hull of claim 1, wherein another of the plurality of starboard cross section is located between the stern and $^2/_3$rds of the length of the hull $L_{lwl}$.

5. The hull of claim 2, wherein none of said plurality of cutting planes intersects said lateral axis.

6. The hull of claim 5, wherein each of said plurality of cutting planes is normal to said longitudinal axis.

7. The hull of claim 2, wherein each of said plurality of cutting planes is normal to one of said at least one starboard straight line.

8. The hull of claim 1, wherein the hull is a multihull.

9. The hull of claim 2, wherein the keel comprises two fins.

10. The hull of claim 9, wherein the two fins are cambered opposite each other.

11. The hull of claim 9, wherein each of two fins have zero lift lines that are not parallel with the centerline.

12. A sailboat hull with a bow, a stern, a starboard side, a port side, a keel, a longitudinal axis, a lateral axis, and a vertical axis, where each of said axes is perpendicular to each of the other axes, comprising:

a first plane defined by said longitudinal axis and said vertical axis;

a bottom surface, said bottom surface being symmetric with respect to said first plane;

at least one starboard straight line;

wherein said at least one starboard straight line lies on said starboard side of said first plane;

wherein said at least one starboard straight line intersects said first plane at a point, where a projection of said point on to a horizontal plane, defined by the lateral axis and the longitudinal axis, is proximate to or aft of said stern;

a plurality of stations located along said at least one starboard straight line, wherein at least one of said plurality of stations is positioned between ⅔ of the length $L_{lwl}$ of the hull and the bow;

wherein each of said plurality of stations comprising:

an orthogonal line, said orthogonal line intersecting said at least one starboard straight line and said bottom surface forming respective intersections, wherein a portion of said bottom surface proximate to the respective intersection is normal to said orthogonal line;

wherein each station's orthogonal line is co-planar with each of the other stations orthogonal line; and, wherein said keel is symmetric with respect to said first plane.

13. The hull of claim 12, wherein each of the orthogonal lines intersecting one of the at least one starboard straight line are coplanar with each of the other orthogonal lines intersecting the respective one of the at least one starboard straight line.

14. The hull of claim 13, wherein the plane containing the orthogonal lines intersects the first plane about the longitudinal axis at an angle $\Phi$, where $0<\Phi<60°$.

15. The hull of claim 13, wherein the keel comprises two fins.

16. The hull of claim 15, wherein the two fins are cambered opposite each other.

17. The hull of claim 15, wherein each of two fins have zero lift lines that are not parallel with the centerline.

18. The hull of claim 12 wherein another of the plurality of stations is located between the stern and ⅔rds of the hull length $L_{lwl}$.

19. In a method of reducing the drag on a sailboat traveling on a body of water under the power of the wind, with a fixed centerline and the sailboat is at a angle of heel to the leeward, the improvement of passively inducing a keel angle of attack $\lambda$ proportional to the angle of heel $\phi$, comprising the steps of:

providing a hull wherein the hull is symmetric with respect to a first plane defined by the centerline and perpendicular to a surface of the body of water when the heel angle $\phi=0$ providing a rigid keel with a zero lift line parallel to said centerline providing at least one starboard path line, said path line parallel to the direction of travel while on a port tack at an angle $\lambda$ from the centerline and intersecting the first plane aft of the stern;

shaping a starboard side of the hull such that a portion of the starboard side proximate to a starboard plane is substantially symmetric with respect to the starboard plane, wherein the starboard plane is perpendicular to the surface of a body of water and includes the at least one starboard path line when the hull is heeled to starboard.

20. The method of claim 19, selecting the ratio $\gamma$ of the angle from the centerline $\lambda$ to the heel angle $\Phi$ from the range of $0.01<\gamma<2$.

21. The method of claim 19, wherein the keel comprises two fins.

22. The method of claim 21, comprising the step of providing the two fins with camber opposite each other.

23. The method of claim 21, comprising the step of providing the each of two fins with zero lift lines that are not parallel with the centerline.

24. A sailboat hull with a bow, a stem, a starboard side, a port side, a keel, a longitudinal axis, a lateral axis, and avertical axis, wherein each of said axes is perpendicular to each of the other axes, comprising:

a first plane defined by said longitudinal axis and said vertical axis;

a bottom surface, said bottom surface being symmetric with respect to said first plane;

a secondary plane, said secondary plane oblique to said first plane and intersecting the longitudinal axis at or aft of the stern and intersecting the bottom surface on the starboard side;

wherein said secondary plane intersects said first plane at an angle $\Phi$ about the longitudinal axis and an angle $\Lambda$ about the vertical axis, where $\Phi$ and $\Lambda$ do not equal zero;

a starboard portion of the bottom surface proximate to the secondary plane is substantially symmetric with respect to the second plane; and, said starboard portion is longitudinally located at least between the mid-ship and bow, having a length of at least 10% of the hull length at the water line $L_{WL}$.

25. The sailboat hull of claim 24, comprising a plurality of secondary planes and a plurality of starboard portions, each of said secondary planes oblique to said first plane and intersecting the longitudinal axis at or aft of the stern and intersecting the bottom surface on the starboard side;

wherein for each of the plurality of secondary planes, one of the plurality of starboard portions of the bottom surface proximate to the respective secondary plane is substantially symmetric with respect to the respective secondary plane; and, wherein said plurality of starboard portions are longitudinally located at least between the mid-ship and the bow, having a length of at least 10% of the hull length at the water line $L_{WL}$.

26. The sailboat hull of claim 25, wherein each of said secondary planes respectively intersects said first plane at angles $\Phi_i$ about the longitudinal axis and angles $\Lambda_i$ about the vertical axis, forming a respective angle set $\Phi_i$, $\Lambda_i$, where i=1 to n, where i designates a respective one of the plurality of secondary planes and n=the number of secondary planes; and, wherein each of the plurality of secondary planes have different angle sets $\Phi_i$, $\Lambda_i$.

27. The sailboat hull of claim 24, wherein the secondary plane is perpendicular to the starboard portion of the bottom surface proximate to the secondary plane at the respective intersection.

28. The sailboat hull of claim 24, wherein the secondary plane bisects an angle formed by the starboard portion of the bottom surface proximate to its intersection with the secondary plane.

29. The sailboat hull of claim 24, wherein the starboard portion is located between the stem and the bow and has a length of at least 50% of the hull length at the waterline $L_{lwl}$.

30. The sailboat hull of claim 24, wherein the starboard portion is located between the stem and the bow and has a length of at least ⅔rds of the hull length at the waterline $L_{lwl}$.

* * * * *